US006893539B2

(12) United States Patent
Scherb

(10) Patent No.: US 6,893,539 B2
(45) Date of Patent: May 17, 2005

(54) MACHINE FOR THE PRODUCTION OF A TISSUE WEB

(75) Inventor: Thomas Thoroe Scherb, Sao Paulo (BR)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/376,451

(22) Filed: Mar. 3, 2003

(65) Prior Publication Data

US 2003/0168193 A1 Sep. 11, 2003

(30) Foreign Application Priority Data

Mar. 5, 2002 (DE) ..... 102 09 582

(51) Int. Cl.[7] ..... D21F 3/06; D21F 11/00

(52) U.S. Cl. ..... 162/358.5; 162/109; 162/198; 162/205; 162/206; 162/252; 162/263; 162/358.3

(58) Field of Search ..... 162/205, 206, 162/198, 199, 252–254, 262, 263, 358.1, 358.3, 361, DIG. 10, 385.5, 360.3; 100/35, 47, 50, 99, 153, 162 B, 170, 176; 73/862.55; 492/7, 10, 20; 700/127–129

(56) References Cited

U.S. PATENT DOCUMENTS

| | | | | | |
|---|---|---|---|---|---|
| 4,791,863 | A | * | 12/1988 | Vahatalo | 100/35 |
| 5,043,046 | A | * | 8/1991 | Laapotti | 162/358.3 |
| 5,383,371 | A | * | 1/1995 | Laitinen | 73/862.55 |
| 5,507,916 | A | * | 4/1996 | Schiel | 162/195 |
| 5,562,027 | A | | 10/1996 | Moore | |
| 5,592,875 | A | * | 1/1997 | Moschel | 100/99 |
| 5,753,083 | A | | 5/1998 | Scheil et al. | |
| 5,953,230 | A | * | 9/1999 | Moore | 700/122 |
| 6,138,506 | A | * | 10/2000 | Neuschutz et al. | 73/159 |
| 6,248,210 | B1 | * | 6/2001 | Edwards et al. | 162/111 |
| 6,352,615 | B1 | * | 3/2002 | Tavi et al. | 162/198 |
| 2002/0069995 | A1 | | 6/2002 | Scherb et al. | |
| 2003/0127211 | A1 | * | 7/2003 | Weigant et al. | 162/263 |

FOREIGN PATENT DOCUMENTS

| | | |
|---|---|---|
| DE | 19522761 | 1/1997 |
| DE | 19642047 | 4/1998 |
| DE | 19654198 | 6/1998 |
| DE | 19654345 | 6/1998 |
| EP | 1016754 | 7/2000 |

* cited by examiner

*Primary Examiner*—Eric Hug
(74) *Attorney, Agent, or Firm*—Greenblum & Bernstein, P.L.C.

(57) ABSTRACT

Machine and process for the production of a tissue web that includes a drying cylinder and a press shoe arrangement. The press shoe arrangement and the drying cylinder are arranged to form a nip with lateral edge areas. A plurality of contact pressing elements are arranged to exert pressing pressures across the nip, a measuring device is structured and arranged to measure pressing pressures resulting in at least the lateral edge areas, and at least one of a control and regulating device is structured and arranged to locally adjust the pressing pressures in the lateral edge areas by adjusting pressing pressures exerted by contact pressing elements assigned to the lateral edge areas. The instant abstract is neither intended to define the invention disclosed in this specification nor intended to limit the scope of the invention in any way.

53 Claims, 4 Drawing Sheets

Maximum
Nip pressure
Nip length
20
22
24
24
24
24
10
18
16
26
26'
26'
26'
26'
L

MACHINE FOR THE PRODUCTION OF A TISSUE WEB

CROSS-REFERENCE TO RELATED APPLICATIONS

The present application claims priority under 35 U.S.C. §119 of German Patent Application No. 102 09 582.5, filed on Mar. 5, 2002, the disclosure of which is expressly incorporated by reference herein in its entirety.

BACKGROUND OF THE INVENTION

1. Field of the Invention

The present invention relates to a machine for the production of a tissue web, with a nip formed between a drying cylinder, in particular a Yankee cylinder, and a press shoe arrangement that can be pressed against the drying cylinder via several contact pressing elements arranged in at least one row extending crosswise to the web travel direction.

2. Discussion of Background Information

Up to now, press shoes were pressed uniformly across the width or with a lower pressure at the edges.

However, the contour of a Yankee drying cylinder of a tissue machine now changes as a result of the steam pressure internally as well as due to a temperature expansion of the face cover. If a press shoe is then pressed against the Yankee cylinder to form a press nip, the course of the pressing pressure in the crosswise direction is no longer constant, but deviates upwards or downwards at the edges. The deviations are not always constant, but depend on the operational parameters, e.g., basis weight, speed, steam pressure, temperature, linear load of the press nip and/or the like. As is known, the linear load can be calculated, as is known, from the pressing pressure profile and the nip geometry. For the same press shoe there is a well-defined correlation.

SUMMARY OF THE INVENTION

The present invention provides a method to control the pressing pressure cross profile and/or the linear load cross profile resulting over the width of the nip, preferably formed by a shoe press, in particular, at the edges, and to be able to adjust them to the desired values. It should be possible thereby to make a corresponding adjustment in particular during operation.

According to the invention, a machine for the production of a tissue web includes a nip formed between a drying cylinder, e.g., a Yankee cylinder, and a press shoe arrangement that can be pressed against the drying cylinder via several contact pressing elements arranged in at least one row extending crosswise to the web travel direction. The machine also includes a measuring device for measuring at least the pressing pressures resulting in the two lateral edge areas of the nip in the range of effect of assigned contact pressing elements and with a control and/or regulating device via which the pressing pressures in the edge areas can be adjusted locally by the contact pressing elements assigned to these edge areas being acted upon accordingly.

The contact pressing elements serving as control elements therefore no longer need to always press the press shoe arrangement with the same constant pre-set force across the width. Now, the edge areas can, in particular, be acted upon with different pressing forces.

Advantageously, at least the contact pressing elements assigned to the edge areas can be acted upon or controlled independently of the respective other contact pressing elements.

In particular, several contact pressing elements can be assigned to each edge area. Preferably, the contact pressing elements of a respective edge area can thereby be acted upon or controlled, at least partly, independently of one another.

Hydraulic contact pressing elements can be provided in particular. These can respectively include at least one cylinder/piston unit.

According to an expedient practical embodiment of the invention, separate hydraulic units are assigned at least to the contact pressing elements provided in the edge areas. However, such an embodiment is also conceivable, for example, in which at least the contact pressing elements assigned to the edge areas can be acted upon by a central hydraulic system via throttles expressly assigned to the respective contact pressing elements.

Advantageously the pressing pressure cross profile can be adjusted in particular in the edge areas via the contact pressing elements. This pressing pressure cross profile can preferably thereby be adjusted during operation.

According to a preferred practical form of the invention, a pressing pressure cross profile regulation is provided.

Advantageously, a respective edge area has a width measured crosswise to the machine travel direction of maximally about 1000 mm and preferably maximally about 700 mm.

According to a preferred practical embodiment of the machine according to the invention, the pressing pressure measuring points, viewed in the machine travel direction, are provided respectively in the area of the maximum of the pressing pressure curve resulting in the machine travel direction.

Viewed in the crosswise direction, the pressing pressure measuring points are advantageously provided in the area of the contact pressing elements.

An indicator device to indicate the measured pressing pressure values can also be provided in particular. Such an indicator device preferably includes several indicator elements assigned to the various pressing pressure measuring points, e.g., manometers or the like.

The indicator device can include indicator elements provided in the area of the press and/or indicator elements provided in the area of a control station or central station.

According to a preferred practical form of the invention, the press shoe arrangement is provided in the area of the pressing pressure measuring points with measuring borings via which the respective pressing pressures resulting in the nip are measured.

Advantageously, three contact pressing elements respectively are provided in the edge areas. In principle, however, more or fewer contact pressing elements can also be provided in the respective edge areas.

Advantageously, the contact pressing elements provided in the edge areas can each be acted upon or controlled independently of one another and independently of the contact pressing elements provided in the central area.

It is also advantageous if, at least in the edge areas, the pressing pressures are adjusted at least partly on the basis of absolute theoretical values.

In principle, however, an embodiment is also conceivable in which, at least in the edge areas, the pressing pressures are adjusted at least partly on the basis of relative theoretical values.

According to an expedient practical embodiment of the invention, the control and/or regulating device receives a reference pressure value from at least one pressing pressure measuring point or from at least one contact pressing element in the central area lying between the two edge areas. The pressing pressures or contact pressing pressures in the edge areas can thereby preferably be adjusting depending on the reference pressure value.

The spacing of the contact pressing elements in the edge areas, given in the crosswise direction, can be at least essentially the same as the spacing of the contact pressing elements in the central area lying between the two edge areas or can differ from the spacing of the contact pressing elements of this central area. In the latter case the spacing of the contact pressing elements in the edge areas is preferably smaller than the spacing of the contact pressing elements in the central area.

The pressing pressures can preferably be adjusted via the control and/or regulating device such as to result in an at least essentially uniform pressing pressure cross profile.

It is also advantageous in particular if the press shoe arrangement has a lower bending stiffness in the edge areas than in the central area lying between the two edge areas.

The press shoe arrangement can include only one single press shoe or else several press shoes.

The contact pressing elements serving as control elements for the contact pressure of the shoe thus no longer need to act always with the same constant force. Instead, the edge areas can now also be acted upon by different contact pressing forces. The hydraulic contact pressing elements or units, e.g., can be acted upon with different pressures in the edge areas independently of the contact pressing elements provided in the center. For this purpose their own hydraulic units can be assigned to the edge areas, or they can be operated with suitable throttles together with the other contact pressing elements via a central hydraulic system. The edge areas are, e.g., maximally about 1000 mm and in particular maximally about 700 mm wide.

In the edge areas, the pressing pressures, preferably the maximum pressing pressures, can be measured, e.g., via borings provided in the press shoes. In the machine travel direction, these measuring borings are preferably positioned in the area in which the pressing pressure curve resulting in the machine travel direction has its maximum. The measured pressures can be indicated, e.g., via manometers on the press or in the control station. In the crosswise direction, the measuring borings are arranged in particular in the area of the preferably hydraulic contact pressing elements. The machine personnel can then adjust the desired pressing pressure at the point in question via a corresponding adjustment of the contact pressing pressure of a respective contact pressing element in the edge area. In this manner, problems such as felt compacting, web overheating, web transfer to the next machine section, and web adhesion conditions on the Yankee cylinder are avoided. Correspondingly, the quality features of the tissue web, such as in particular solids content, bulk, crepe quality, etc. can also be adjusted optimally in the critical edge areas.

In particular, a press shoe arrangement with pressure measuring devices for measuring the pressing pressure at representative points in the area of the preferably hydraulic contact pressing elements can be provided in the edge area of a tissue machine. The measured pressures can be compared with pre-set theoretical values and corrected to these theoretical values by adjusting the local shoe contact pressing forces correspondingly.

The invention has a particularly advantageous effect with Yankee cylinders that feature internal ribs to stiffen the cylinder jacket, as described, e.g., in DE-A 196 54 345.

The present invention is directed to a machine for the production of a tissue web that includes a drying cylinder and a press shoe arrangement. The press shoe arrangement and the drying cylinder are arranged to form a nip with lateral edge areas. A plurality of contact pressing elements are arranged to exert pressing pressures across the nip, a measuring device is structured and arranged to measure pressing pressures resulting in at least the lateral edge areas, and at least one of a control and regulating device is structured and arranged to locally adjust the pressing pressures in the lateral edge areas by adjusting pressing pressures exerted by contact pressing elements assigned to the lateral edge areas.

According to a feature of the invention, the drying cylinder can be a Yankee cylinder.

Further, the plurality of contact pressing elements are arranged in at least one row extending crosswise to a web travel direction. The pressing pressures measured by the measuring device are determined in a region of the contact pressing elements assigned to the lateral edge areas.

In accordance with another feature of the present invention, at least the contact pressing elements assigned to the lateral edge areas can be one of acted upon or controlled independently of the other contact pressing elements.

Several of the plurality of contact pressing elements are assigned to respective lateral edge areas and the several contact pressing elements are one of acted upon or controlled, at least partly, independently of one another.

According to still another feature of the invention, the plurality of contact pressing elements can include hydraulic contact pressing elements. The hydraulic contact pressing elements may include at least one cylinder/piston unit.

Moreover, the plurality of contact pressing elements can include hydraulic contact pressing units, and at least the contact pressing elements assigned to the lateral edge areas may be composed of separate hydraulic contact pressing units.

The machine can also include a central hydraulic system, and the plurality of contact pressing elements can include hydraulic contact pressing units, and at least the hydraulic contact pressing units assigned to the lateral edge areas may be acted upon by the central hydraulic system via throttles expressly assigned to respective hydraulic contact pressing units.

Further, the contact pressing elements are structured and arranged to adjust a pressing pressure cross profile in the lateral edge areas. The pressing pressure cross profile is adjustable during operation of the machine. Further still, the contact pressing elements are structured and arranged to facilitate regulation of the pressing pressure cross profile.

According to still another feature of the instant invention, at least one lateral edge area can have a width measured crosswise to a machine travel direction that is a maximum of about 1000 mm. Preferably, the width is maximally about 700 mm. Further, both lateral edge areas can have a maximum width of about 1000 mm.

The press shoe arrangement can further include pressing pressure measuring points located in an area of a maximum pressing pressure established by a pressing pressure curve resulting in the machine travel direction. The pressing pressure measuring points are arranged to extend crosswise to the machine travel direction. Further, the pressing pressure measuring points can be arranged in areas of the contact pressing elements.

According to a further feature of the invention, the measuring device can include an indicator device structured and arranged to indicate measured pressing pressure values. The press shoe arrangement can further include pressing pressure measuring points arranged to extend crosswise to a machine travel direction. The indicator device may include a plurality of indicator elements assigned to the pressing pressure measuring points. The plurality of indicator devices may be manometers. Further, the indicator device can include indicator elements located in an area of the nip. Still further, the indicator device may include indicator elements located in an area of one of a control station or central station.

According to a still further feature of the invention, the press shoe arrangement can further include measuring bores, located in an area of maximum pressing pressure in a machine direction, through which respective pressing pressures resulting in the nip are measured.

In accordance with another feature of the instant invention, the contact pressing elements assigned to the lateral edge area may include three contact pressing elements.

The contact pressing elements assigned to the lateral edge areas can be one of acted upon or controlled independently of one another. The contact pressing elements assigned to the lateral edge areas can be one of acted upon or controlled independently of contact pressing elements provided in a central area of the nip between the lateral edge areas.

Moreover, at least in the lateral edge areas, the control and/or regulating device is structured and arranged to at least partly adjust the pressing pressures based upon absolute theoretical values.

Further, at least in the lateral edge areas, the control and/or regulating device is structured and arranged to at least partly adjust the pressing pressures based on relative theoretical values.

According to still another feature, the control and/or regulating device is structured and arranged to receive a reference pressure value. Still further, the press shoe arrangement further includes pressing pressure measuring points arranged at a position of maximum pressing force in a machine travel direction, and the reference pressure value is sent from one of (1) at least one of the pressing pressure measuring points or (2) at least one contact pressing element located in a central area lying between the lateral edge areas. The control and/or regulating device adjusts one of the pressing pressures or contact pressing pressures in the lateral edge areas depending on the reference pressure value.

Still further, viewed in a crosswise direction, a spacing between neighboring contact pressing elements assigned to the lateral edge areas is at least essentially the same as a spacing between neighboring contact pressing elements in a central area located between the lateral edge areas.

Moreover, viewed in a crosswise direction, a spacing between neighboring contact pressing elements assigned to the lateral edge areas differs from a spacing between neighboring contact pressing elements in a central area located between the lateral edge areas. The spacing between neighboring contact pressing elements in the lateral edge areas is smaller than the spacing between neighboring contact pressing elements in the central area.

According to a further feature of the invention, the control and/or regulating device is structured and arranged to adjust the pressing pressures to achieve an at least essentially uniform pressing pressure cross profile.

The press shoe arrangement has a lower bending stiffness in an area associated with the lateral edge areas than a central area located between the area associated with the lateral edge areas.

Further, the press shoe arrangement is formed by only a single press shoe. Alternatively, the press shoe arrangement is formed by at least two press shoes.

The present invention is directed to a process for the production of a tissue web in a machine that includes a drying cylinder and a press shoe arrangement arranged to form a nip with lateral edge areas, and a plurality of contact pressing elements. The process includes actuating the plurality of contact pressing elements to exert pressing pressures across the nip, measuring pressing pressures resulting in at least the lateral edge areas, and locally adjusting the pressing pressures in the lateral edge areas by adjusting pressing pressures exerted by contact pressing elements assigned to the lateral edge areas.

In accordance with a feature of the invention, the pressing pressures can be exerted against a Yankee cylinder.

The plurality of contact pressing elements are arranged in at least one row extending crosswise to a web travel direction. Further, the process can further include measuring the pressing pressures in a region of the contact pressing elements assigned to the lateral edge areas.

In accordance with another feature of the invention, the process may further include one of independently acting upon or controlling the other contact pressing elements.

According to still another feature of the instant invention, the process can further include one of independently acting upon or controlling, at least partly, the plurality of contact pressing elements assigned to respective lateral edge areas.

In accordance with another feature, the process can further include adjusting a pressing pressure cross profile in the lateral edge areas. The pressing pressure cross profile can be adjusted during operation of the machine.

At least in the lateral edge areas, the process may further include at least partly adjusting the pressing pressures based upon absolute theoretical values.

Moreover, at least in the lateral edge areas, the process can further include at least partly adjusting the pressing pressures based on relative theoretical values.

The process can further include receiving a reference pressure value from one of (1) at least one pressing pressure measuring points arranged at a position of maximum pressing force in a machine travel direction and (2) at least one contact pressing element located in a central area lying between the lateral edge areas. Still further, the process may further include adjusting one of the pressing pressures or contact pressing pressures in the lateral edge areas depending on the reference pressure value.

In accordance with still yet another feature of the present invention, the process can further include adjusting the pressing pressures to achieve an at least essentially uniform pressing pressure cross profile.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
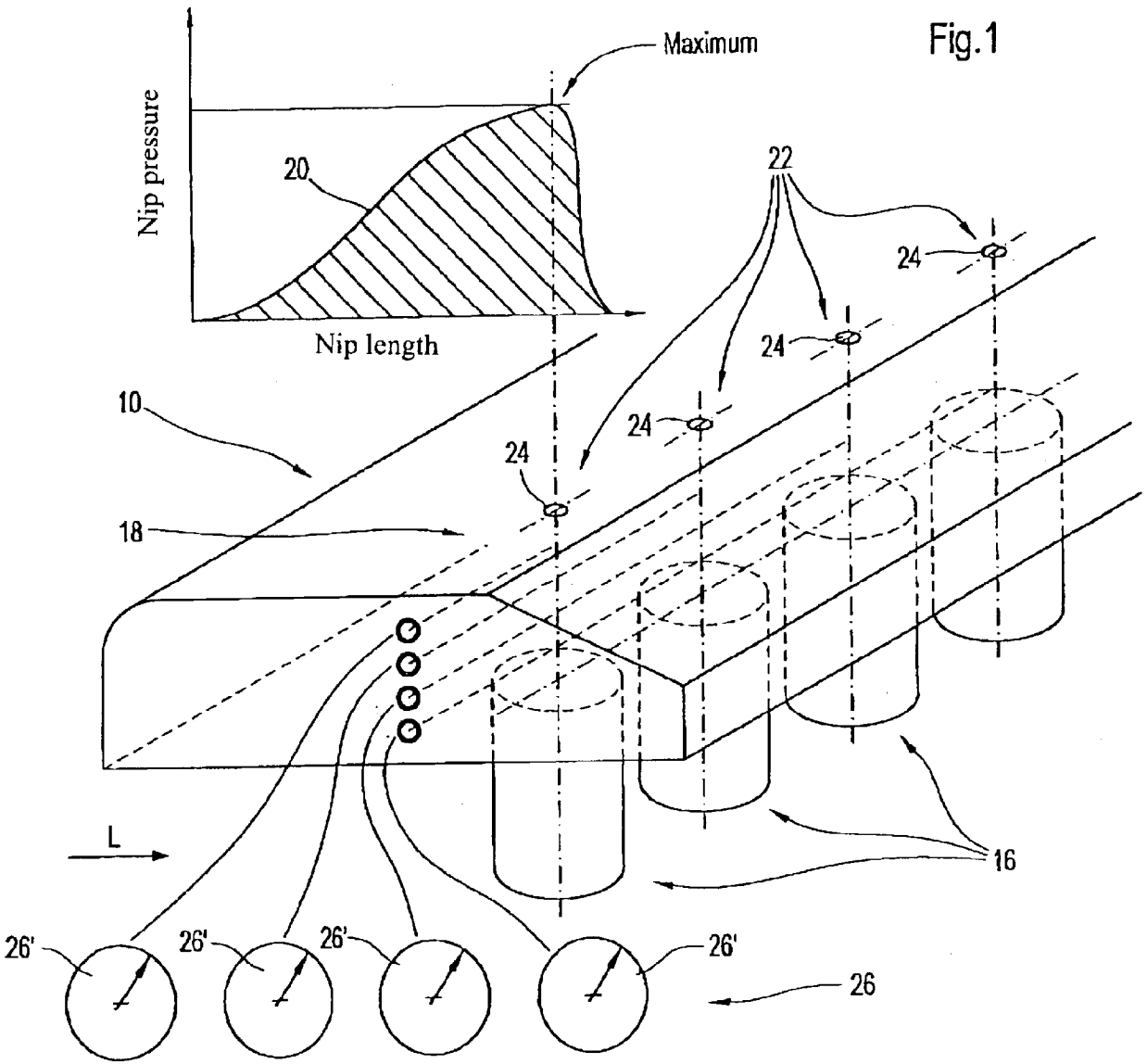
FIG. 1 schematically illustrates a partial perspective view of a press shoe arrangement for forming a nip with a drying cylinder.

FIG. 1 illustrates, in schematic perspective partial representation, a press shoe arrangement 10 that can be provided adjacent a drying cylinder 12, in particular a so-called "Yankee cylinder" (see FIGS. 2–4) to form a nip 14 in a tissue machine. Press shoe arrangement 10 can include one or more press shoes.

Press shoe arrangement 10 can be pressed against drying cylinder 12 via several contact pressing elements 16. Contact pressing elements 16 can be, e.g., hydraulic contact pressing elements, each of which can include at least one cylinder/piston unit.

As can be seen from FIG. 1, contact pressing elements 16 are arranged in a row extending crosswise to web travel direction L. In principle, several such rows of contact pressing elements can also be provided.

A measuring device 18 is provided for measuring at least the pressing pressures resulting in the two lateral edge areas of nip 14 as a result of the actuation of contact pressing elements 16.

In the upper part of FIG. 1, a pressing pressure curve 20 resulting in the machine travel direction L is shown. The area under this curve corresponds to the linear load, e.g., in kN/m. As can be seen from FIG. 1, a contact pressing elements 16 viewed in machine travel direction L can be provided respectively in the area of the maximum of pressing pressure curve 20. The pressing pressure can be given in units of, e.g., $kN/m^2$ or Pa.

Measuring borings 24 are provided in an area of press shoe arrangement 10 to define pressing pressure measuring points 22 and to measure the respective pressing pressures resulting in the nip. Viewed in machine travel direction L, the pressing pressure measuring points 22 defined by measuring borings 24 are respectively again provided in the area of the maximum of a pressing pressure curve 20. Viewed in the crosswise direction, pressing pressure measuring points 22 are provided in the area of contact pressing elements 16.

As can be seen from FIG. 1, an indicator device 26 is provided to indicate the measured pressing pressure values. Indicator device 26 can include several indicator elements 26', e.g., manometers or the like, assigned to the various pressing pressure measuring points 22.

Indicator device 26 can include indicator elements 26' provided in the area of the press and/or in the area of a control station or central station.

In the illustrated case, a pressing pressure measuring point 22 is respectively provided per contact pressing element 16.

Contact pressing elements 16 provided in the edge areas can expediently be acted upon or controlled independently of one another and independently of central contact pressing elements 16.

Several contact pressing elements 16 can be assigned to a respective edge area. In the exemplary embodiments shown in FIGS. 3 and 4, for example, three contact pressing elements $\mathbf{16}_1$–$\mathbf{16}_3$ or $\mathbf{16}_4$–$\mathbf{16}_6$ are assigned respectively to the two lateral edge areas.

The pressing pressures in the edge areas can be adjusted locally, for example, via a control and/or regulating device 28 (cf. also FIG. 4), by being acted upon correspondingly by contact pressing elements $\mathbf{16}_1$–$\mathbf{16}_3$ or $\mathbf{16}_4$–$\mathbf{16}_6$ assigned to these edge areas.

The pressing pressure cross profile can preferably be adjusted in the desired manner via contact pressing elements 16, in particular in the edge areas. Moreover, this adjustment can also take place in particular during operation. A pressing pressure cross profile regulation can thereby be provided.

Figure 2:
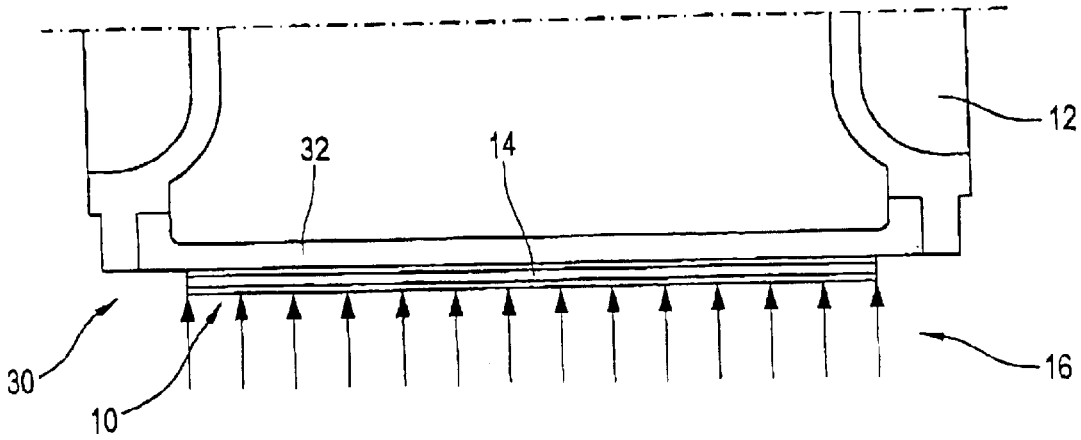
FIG. 2 schematically illustrates a longitudinal sectional depiction of a shoe press including a Yankee cylinder with an assigned press shoe arrangement in the unloaded state.

FIG. 2 shows a schematic longitudinal sectional representation of a shoe press 30 including a drying cylinder 12, e.g., a Yankee cylinder, with an assigned press shoe arrangement 10 in an unloaded state, such that a jacket 32 of drying cylinder 12 is not bent in the present case.

As press shoe arrangement 10 is pressed against drying cylinder 12 by at least one row of contact pressing elements 16, press shoe arrangement 10 forms nip 14 with drying cylinder 12. The tissue web is conducted through nip 14 together with at least one support belt (not shown). Preferably the tissue web runs through this press nip or nip 14 together with a water-impermeable press jacket and a felt (water-absorbing).

Figure 3:
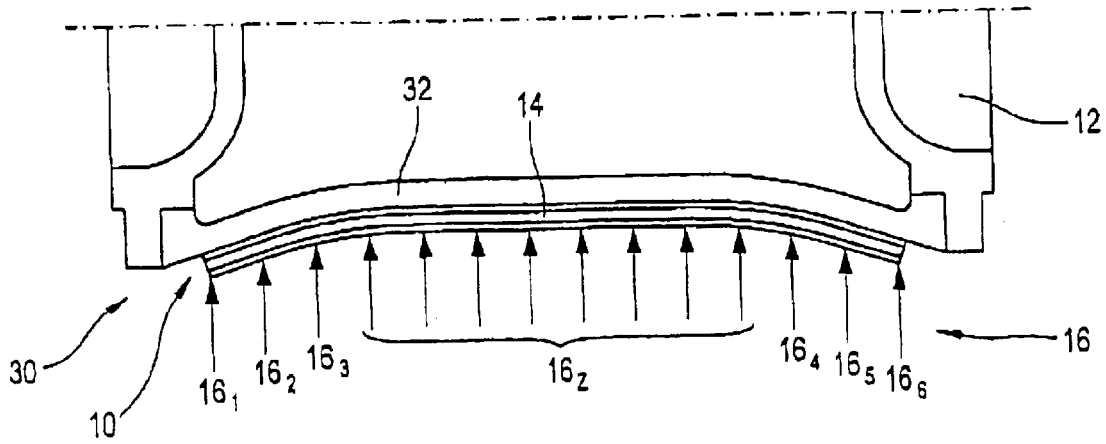
FIG. 3 schematically illustrates a longitudinal sectional representation of the shoe press including a Yankee cylinder with an assigned press shoe arrangement in the operational (loaded) state.

FIG. 3 shows a representation of shoe press 30 comparable with that of FIG. 2, except that the device is depicted in a loaded, i.e., operational, state. In the operational state, the contour of drying (Yankee) cylinder 12 is deformed by internal cylinder pressure (steam) and a stronger expansion of the face cover of drying cylinder 12 as a result of the steam temperature, as well as by other design-related factors. Moreover the contour of drying cylinder 12 is influenced particularly in the area of press nip 14 by various pressing pressures or linear loads, such that jacket 32 of drying cylinder 12 is therefore bent here. As can be seen from FIG. 3, a corresponding bending also results in press shoe arrangement 10.

In the present case, three contact pressing elements 16 are assigned respectively to the two lateral edge areas of press shoe arrangement 10, i.e., pressing elements $\mathbf{16}_1$–$\mathbf{16}_3$ and $\mathbf{16}_4$–$\mathbf{16}_6$. The contact pressing elements assigned to the central area are identified as $\mathbf{16}_z$.

Contact pressing elements $\mathbf{16}_i$, in particular hydraulic contact pressing elements, can be acted upon with different pressures, such that correspondingly different contact pressing forces are produced. Contact pressing elements 16 can thereby be acted upon and/or controlled in particular in such a way that an at least essentially uniform pressing pressure cross profile or linear load profile results in nip 14.

Figure 4:
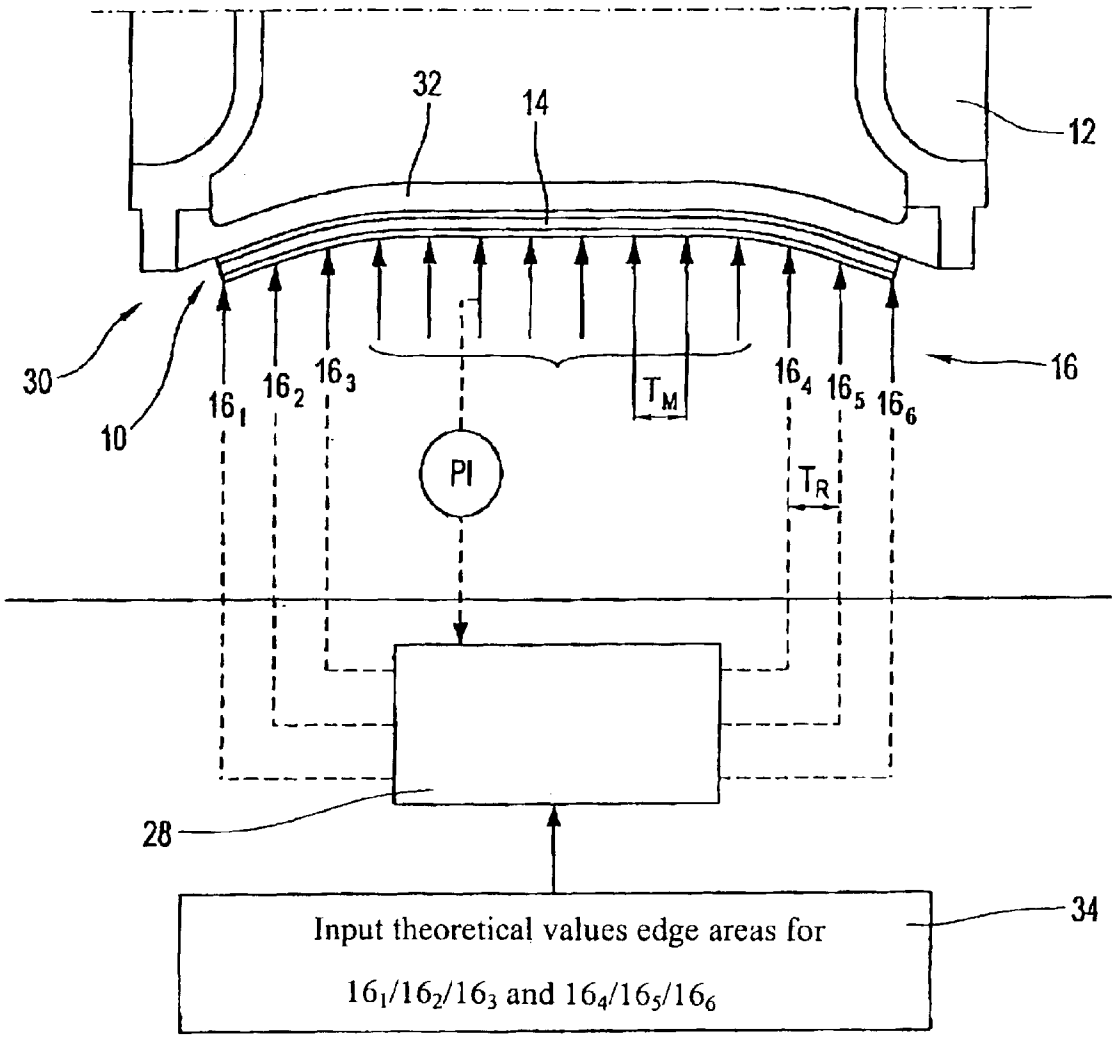
FIG. 4 schematically illustrates a longitudinal sectional representation of the shoe press including a Yankee cylinder with an assigned press shoe arrangement with an assigned control and/or regulating device.

FIG. 4 shows, in schematic longitudinal sectional representation, shoe press 30 composed of a drying cylinder 12, e.g., a Yankee cylinder, and an assigned press shoe arrangement 10. A control and/or regulating device 28 is arranged to locally adjust the pressing pressures in the edge areas of nip 14 by actuating contact pressing elements $\mathbf{16}_1$–$\mathbf{16}_3$ and $\mathbf{16}_4$–$\mathbf{16}_6$ assigned to the lateral edge areas.

Separate hydraulic units, e.g., can be assigned to at least contact pressing elements $\mathbf{16}_1$–$\mathbf{16}_3$ and $\mathbf{16}_4$–$\mathbf{16}_6$ assigned to the edge areas. However, contact pressing elements 16 can also be acted upon by a central hydraulic system via throttles expressly assigned to the respective contact pressing elements.

As can be seen from FIG. 4, the pressing pressure cross profile can now be adjusted or controlled and/or regulated in the desired manner, in particular in the edge areas, via control and/or regulating device 28 and contact pressing elements 16. In the present case, e.g., three contact pressing elements $\mathbf{16}_1$–$\mathbf{16}_3$ and $\mathbf{16}_4$–$\mathbf{16}_6$ are provided respectively in the two lateral edge areas. However, in principle, more or fewer contact pressing elements 16 can also be provided in a respective edge area. Particularly with greater pressure gradients, i.e., with strong local deformation of drying cylinder 12, four or more pressure measuring points are advantageous. This may also make a narrower spacing necessary for contact pressing elements 16 and measuring points 22, e.g., less than or equal to 170 mm.

A respective edge area can have a width, measured crosswise to the machine travel direction, of, e.g., maximally about 1000 mm and preferably maximally about 700 mm.

An input device 34 is arranged for inputting theoretical values for the controlled contact pressing elements to control and/or regulating device 28. In this manner, the pressing pressures can be adjusted, at least in the edge areas, at least partly on the basis of absolute theoretical values and/or on the basis of relative theoretical values.

In the present case, control and/or regulating device 28 receives a reference pressure value from at least one pressing pressure measuring point 22 or from at least one contact pressing element 16 in the central area lying between the two edge areas. The pressing pressures or contact pressing pressures in the edge areas can therefore be adjusted depending on the reference pressure value. Further, the reference pressure value can be in particular a pressure value in nip 14 measured at a respective pressing pressure measuring point 22, or a pressure measured in the assigned contact pressing element 16. Contact pressing elements $\mathbf{16}_1$–$\mathbf{16}_3$ and $\mathbf{16}_4$–$\mathbf{16}_6$ assigned to the two edge areas are then acted upon accordingly via control and/or regulating device 28.

A spacing $T_R$ in the crosswise direction of contact pressing elements 16 in the edge zones can be at least essentially the same as a spacing $T_M$ of contact pressing elements 16 in the central area lying between the two edge areas, or can differ from spacing $T_M$ of central contact pressing elements 16. In the latter case, spacing $T_R$ of contact pressing elements 16 in the edge areas is preferably smaller than spacing $T_M$ of the central contact pressing elements 16.

Thus, in the present case, contact pressing elements 16 can be acted upon with varying pressures.

The pressing pressures can be adjusted or controlled and/or regulated in particular via control and/or regulating device 28 in such a way as to result in an at least essentially uniform pressing pressure cross profile or linear load cross profile.

Press shoe arrangement 10 can have a lower bending stiffness in the edge areas than in the central area lying between the two edge areas.

Figure 5:
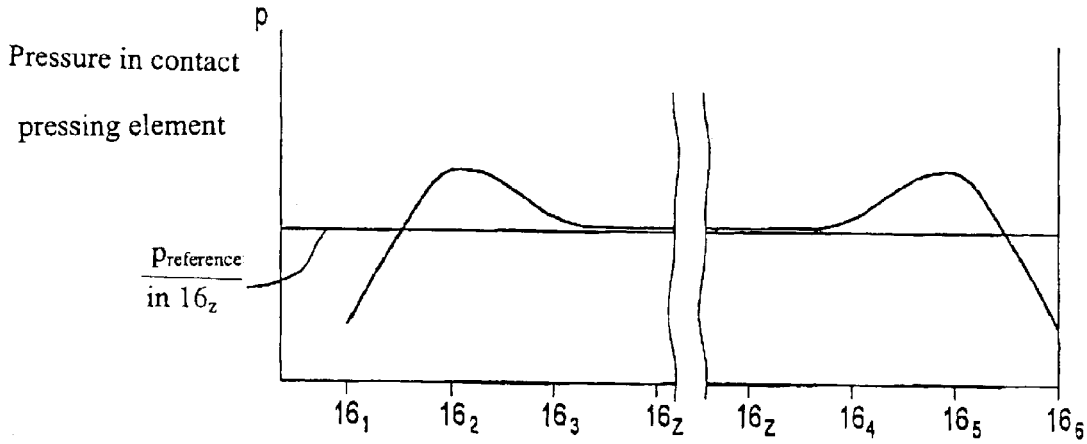
FIG. 5 diagrammatically illustrates an exemplary course of the pressures resulting in the contact pressing elements.

FIG. 5 shows a diagram in which an exemplary course of the pressures resulting in contact pressing elements $\mathbf{16}_i$ is shown. The reference pressure is given as $P_{reference}$.

By way of example, the following pressures can be present, whereby the pressure in contact pressing elements $\mathbf{16}_i$ is given as $p_i$:

$$P_6=P_1=8\cdot10^5 \text{ Pa}$$

$$P_5=P_2=40\cdot10^5 \text{ Pa}$$

$$P_4=P_3=P_{reference}=27\cdot10^5 \text{ Pa}$$

A uniform optimal pressing pressure cross profile is achieved by such a characteristic pressure course according to the invention at the edges, so that the produced paper or tissue web features a desired uniform moisture cross profile. As an advantage, among other things longer felt running times result, since the felt is no longer variably compacted or compressed in the nip.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

10 Press shoe arrangement
12 Drying cylinder, Yankee cylinder
14 Nip
16 Contact pressing element
18 Measuring device
20 Pressing pressure curve
22 Pressing pressure measuring point
24 Measuring boring
26 Indicator device
26 Indicator element
28 Control and/or regulating device
30 Shoe press
32 Jacket
34 Input device
36 Reference pressure
L Web travel direction
$T_M$ Spacing of the central contact pressing elements
$T_R$ Spacing of the contact pressing elements in the edge area

What is claimed:

1. A machine for the production of a tissue web, comprising:

a drying cylinder;

a press shoe arrangement, said press shoe arrangement and said drying cylinder being arranged to form a nip with lateral edge areas;

a plurality of contact pressing elements arranged to exert pressing pressures across said nip;

a measuring device structured and arranged to measure pressing pressures resulting in at least said lateral edge areas; and at least one of a control and regulating device structured and arranged to locally adjust the pressing pressures in said lateral edge areas by adjusting pressing pressures exerted by contact pressing elements assigned to said lateral edge areas.

2. The machine in accordance with claim 1, wherein said drying cylinder comprises a Yankee cylinder.

3. The machine in accordance with claim 1, wherein said plurality of contact pressing elements are arranged in at least one row extending crosswise to a web travel direction.

4. The machine in accordance with claim 3, wherein the pressing pressures measured by said measuring device are determined in a region of said contact pressing elements assigned to said lateral edge areas.

5. The machine in accordance with claim 1, wherein at least said contact pressing elements assigned to said lateral edge areas are one of acted upon or controlled independently of the other contact pressing elements.

6. The machine in accordance with claim 1, wherein several of said plurality of contact pressing elements are assigned to respective lateral edge areas and said several contact pressing elements are one of acted upon or controlled, at least partly, independently of one another.

7. The machine in accordance with claim 1, wherein said plurality of contact pressing elements comprises hydraulic contact pressing elements.

8. The machine in accordance with claim 7, wherein said hydraulic contact pressing elements comprise at least one cylinder/piston unit.

9. The machine in accordance with claim 1, wherein said plurality of contact pressing elements comprises hydraulic contact pressing units, and at least said contact pressing elements assigned to said lateral edge areas are composed of separate hydraulic contact pressing units.

10. The machine in accordance with claim 1, further comprising a central hydraulic system, wherein said plurality of contact pressing elements comprises hydraulic contact pressing units, and at least said hydraulic contact pressing units assigned to said lateral edge areas are acted upon by said central hydraulic system via throttles expressly assigned to respective hydraulic contact pressing units.

11. The machine in accordance with claim 1, wherein said contact pressing elements are structured and arranged to adjust a pressing pressure cross profile in said lateral edge areas.

12. The machine in accordance with claim 11, wherein said pressing pressure cross profile is adjustable during operation of said machine.

13. The machine in accordance with claim 11, wherein said contact pressing elements are structured and arranged to facilitate regulation of said pressing pressure cross profile.

14. The machine in accordance with claim 1, wherein at least one lateral edge area has a width measured crosswise to a machine travel direction that is a maximum of about 1000 mm.

15. The machine in accordance with claim 14, wherein said width is maximally about 700 mm.

16. The machine in accordance with claim 14, wherein both lateral edge areas have a maximum width of about 1000 mm.

17. The machine in accordance with claim 1, said press shoe arrangement further comprising pressing pressure measuring points located in an area of a maximum pressing pressure established by a pressing pressure curve resulting in the machine travel direction.

18. The machine in accordance with claim 17, wherein said pressing pressure measuring points are arranged to extend crosswise to said machine travel direction.

19. The machine in accordance with claim 17, wherein said pressing pressure measuring points are arranged in areas of said contact pressing elements.

20. The machine in accordance with claim 1, wherein said measuring device comprising an indicator device structured and arranged to indicate measured pressing pressure values.

21. The machine in accordance with claim 20, said press shoe arrangement further comprising pressing pressure measuring points arranged to extend crosswise to a machine travel direction, wherein said indicator device comprises a plurality of indicator elements assigned to said pressing pressure measuring points.

22. The machine in accordance with claim 21, wherein said plurality of indicator devices include manometers.

23. The machine in accordance with claim 20, wherein said indicator device comprises indicator elements located in an area of said nip.

24. The machine in accordance with claim 20, wherein said indicator device comprises indicator elements located in an area of one of a control station or central station.

25. The machine in accordance with claim 1, wherein said press shoe arrangement further comprising measuring bores, located in an area of maximum pressing pressure in a machine direction, through which respective pressing pressures resulting in said nip are measured.

26. The machine in accordance with claim 1, wherein said contact pressing elements assigned to said lateral edge area comprises three contact pressing elements.

27. The machine in accordance with claim 1, wherein said contact pressing elements assigned to said lateral edge areas are one of acted upon or controlled independently of one another.

28. The machine in accordance with claim 27, wherein said contact pressing elements assigned to said lateral edge areas are one of acted upon or controlled independently of contact pressing elements provided in a central area of said nip between said lateral edge areas.

29. The machine in accordance with claim 1, wherein, at least in said lateral edge areas, said control and/or regulating device is structured and arranged to at least partly adjust the pressing pressures based upon absolute theoretical values.

30. The machine in accordance with claim 1, wherein, at least in said lateral edge areas, said control and/or regulating device is structured and arranged to at least partly adjust the pressing pressures based on relative theoretical values.

31. The machine in accordance with claim 1, wherein said control and/or regulating device is structured and arranged to receive a reference pressure value.

32. The machine in accordance with claim 31, wherein said press shoe arrangement further comprises pressing pressure measuring points arranged at a position of maximum pressing force in a machine travel direction, and said reference pressure value is sent from one of (1) at least one of said pressing pressure measuring points or (2) at least one contact pressing element located in a central area lying between said lateral edge areas.

33. The machine in accordance with claim 32, wherein said control and/or regulating device adjusts one of said pressing pressures or contact pressing pressures in said lateral edge areas depending on said reference pressure value.

34. The machine in accordance with claim 1, wherein, viewed in a crosswise direction, a spacing between neighboring contact pressing elements assigned to said lateral edge areas is at least essentially the same as a spacing between neighboring contact pressing elements in a central area located between said lateral edge areas.

35. The machine in accordance with claim 1, wherein, viewed in a crosswise direction, a spacing between neighboring contact pressing elements assigned to said lateral edge areas differs from a spacing between neighboring contact pressing elements in a central area located between said lateral edge areas.

36. The machine in accordance with claim 35, wherein said spacing between neighboring contact pressing elements in said lateral edge areas is smaller than said spacing between neighboring contact pressing elements in said central area.

37. The machine in accordance with claim 1, wherein said control and/or regulating device is structured and arranged to adjust the pressing pressures to achieve an at least essentially uniform pressing pressure cross profile.

38. The machine in accordance with claim 1, wherein said press shoe arrangement has a lower bending stiffness in an area associated with said lateral edge areas than a central area located between said area associated with said lateral edge areas.

39. The machine in accordance with claim 1, wherein said press shoe arrangement is formed by only a single press shoe.

40. The machine in accordance with claim 1, wherein said press shoe arrangement is formed by at least two press shoes.

41. A process for the production of a tissue web in a machine that includes a drying cylinder and a press shoe arrangement arranged to form a nip with lateral edge areas, and a plurality of contact pressing elements, said process comprising:

actuating the plurality of contact pressing elements to exert pressing pressures across the nip;

measuring pressing pressures resulting in at least the lateral edge areas; and locally adjusting the pressing pressures in the lateral edge areas by adjusting pressing pressures exerted by contact pressing elements assigned to the lateral edge areas.

42. The process in accordance with claim 41, wherein the pressing pressures are exerted against a Yankee cylinder.

43. The process in accordance with claim 41, wherein the plurality of contact pressing elements are arranged in at least one row extending crosswise to a web travel direction.

44. The process in accordance with claim 43, further comprising measuring the pressing pressures in a region of the contact pressing elements assigned to the lateral edge areas.

45. The process in accordance with claim 41, further comprising one of independently acting upon or controlling the other contact pressing elements.

46. The process in accordance with claim 41, further comprising one of independently acting upon or controlling, at least partly, the plurality of contact pressing elements assigned to respective lateral edge areas.

47. The process in accordance with claim 41, further comprising adjusting a pressing pressure cross profile in the lateral edge areas.

48. The process in accordance with claim 47, wherein the pressing pressure cross profile is adjusted during operation of the machine.

49. The process in accordance with claim 41, wherein, at least in the lateral edge areas, said process further comprises at least partly adjusting the pressing pressures based upon absolute theoretical values.

50. The process in accordance with claim 41, wherein, at least in the lateral edge areas, said process further comprises at least partly adjusting the pressing pressures based on relative theoretical values.

51. The process in accordance with claim 41, further comprising receiving a reference pressure value from one of (1) at least one pressing pressure measuring points arranged at a position of maximum pressing force in a machine travel direction and (2) at least one contact pressing element located in a central area lying between the lateral edge areas.

52. The process in accordance with claim 51, further comprising adjusting one of the pressing pressures or contact pressing pressures in the lateral edge areas depending on the reference pressure value.

53. The process in accordance with claim 41, further comprising adjusting the pressing pressures to achieve an at least essentially uniform pressing pressure cross profile.

* * * * *